US011089399B1

(12) United States Patent
Tan et al.

(10) Patent No.: US 11,089,399 B1
(45) Date of Patent: Aug. 10, 2021

(54) EAR TIP WITH WEDGE-SHAPED APERTURES AND EARPIECE WITH THE SAME

(71) Applicant: Creative Technology Ltd, Singapore (SG)

(72) Inventors: Woon Pheng Tan, Singapore (SG); Long Chye Low, Singapore (SG); Choon Kiat Teh, Singapore (SG)

(73) Assignee: Creative Technology Ltd, Singapore (SG)

( * ) Notice: Subject to any disclaimer, the term of this patent is extended or adjusted under 35 U.S.C. 154(b) by 2 days.

(21) Appl. No.: 16/779,401

(22) Filed: Jan. 31, 2020

(51) Int. Cl.
*H04R 1/10* (2006.01)
*H04R 1/24* (2006.01)

(52) U.S. Cl.
CPC ..... *H04R 1/1091* (2013.01); *H04R 1/245* (2013.01); *H04R 2201/105* (2013.01)

(58) Field of Classification Search
CPC ..... H04R 1/10; H04R 1/1016; H04R 1/1058; H04R 1/1091; H04R 1/20; H04R 1/22; H04R 2201/10; H04R 2201/105; H04R 2225/025; H04R 2460/09; H04R 2460/11
See application file for complete search history.

(56) References Cited

U.S. PATENT DOCUMENTS 4,375,016 A * 2/1983 Harada ..... H04R 25/656 181/135
2008/0013767 A1* 1/2008 Olsen ..... H04R 25/654 381/328
2020/0154189 A1* 5/2020 Tiscareno ..... H04R 1/1066

* cited by examiner

*Primary Examiner* — Kile O Blair
(74) *Attorney, Agent, or Firm* — Russell Swerdon; Desmond Gean

(57) ABSTRACT

In accordance with the present invention, an ear tip for increasing mid-range frequency perception of an earpiece is provided. The ear tip includes a hollow main body having a first end defining a first opening and a second end defining a second opening for coupling to a coupling portion of a housing of the earpiece, and a peripheral portion integrally coupled to an outer surface of the first opening and shaped to conform to a surface of an ear canal. The peripheral portion has an outer edge with a plurality of wedge-shaped apertures formed integrally and spaced around the outer edge. The second opening and/or the coupling portion of the housing are adapted to be acoustically coupled with each other.

20 Claims, 7 Drawing Sheets

600

600

EAR TIP WITH WEDGE-SHAPED APERTURES AND EARPIECE WITH THE SAME

TECHNICAL FIELD

The present invention generally relates to ear tips for use with earpieces, and more particularly relates to ear tips having wedge-shaped apertures which alters the perception of audio.

BACKGROUND

Ear tips are used in conjunction with earpieces to deliver sound when placed within human ears. Conventional ear tips for use with in-ear earpieces usually substantially seals the entrance of a user's ear canal so as to substantially block external noise from the environment. However, this causes occlusion effect and thus an undesirable listening experience. Another conventional ear tip may have an incomplete seal to prevent the occlusion effect. However, this causes loss of audio quality, in particular the substantial loss of Sound Pressure Level (SPL) in the lower frequencies. Conventional in-ear earpieces with conventional ear tips usually are uncomfortable to wear for extended periods of time due to pressure and heat built-up inside the ear chamber, and some may emphasize bass and treble frequency reproductions over mid-range frequency reproduction, to the detriment of vocals and lead instruments audio.

Thus, it can be seen that what is needed is an ear tip that overcomes occlusion effect of in-ear earpieces, yet allows the user to perceive audio which retains a portion of the lower frequencies, enhances a portion of the mid-range frequencies and is comfortable to wear for extended periods of time. Furthermore, other desirable features and characteristics will become apparent from the subsequent detailed description and the appended claims, taken in conjunction with the accompanying drawings and this background of the disclosure.

SUMMARY

In one aspect of the invention, an ear tip for increasing mid-range frequency perception of an earpiece is provided. The ear tip includes a hollow main body having a first end defining a first opening and a second end defining a second opening for coupling to a coupling portion of a housing of the earpiece, and a peripheral portion integrally coupled to an outer surface of the first opening and shaped to conform to a surface of an ear canal. The peripheral portion has an outer edge with a plurality of wedge-shaped apertures formed integrally and spaced around the outer edge. The second opening and/or the coupling portion of the housing are adapted to be acoustically coupled with each other.

In another aspect of the invention, an earpiece is provided. The earpiece includes a housing defining an acoustic passage to deliver sound energy as an acoustic source and an ear tip that is detachably coupled to the housing of the earpiece. The ear tip includes a hollow main body having a first end defining a first opening and a second end defining a second opening for detachably coupling to the acoustic passage, and a peripheral portion integrally coupled to an outer surface of the first opening and shaped to conform to a surface of an ear canal. The peripheral portion has an outer edge with a plurality of wedge-shaped apertures formed integrally and spaced around the outer edge. The second opening and/or the acoustic passage are adapted to be acoustically coupled with each other.

DETAILED DESCRIPTION OF PREFERRED EMBODIMENTS

The following detailed description is merely exemplary in nature and is not intended to limit the invention or the application and uses of the invention. Furthermore, there is no intention to be bound by any theory presented in the preceding background of the invention or the following detailed description. It is the intent of the present embodiment to present an ear tip that overcomes occlusion effect of in-ear earpieces, yet allows the user to perceive audio which retains a portion of the lower frequencies, enhances a portion of the mid-range frequencies and is comfortable to wear for extended periods of time.

Figure 1:
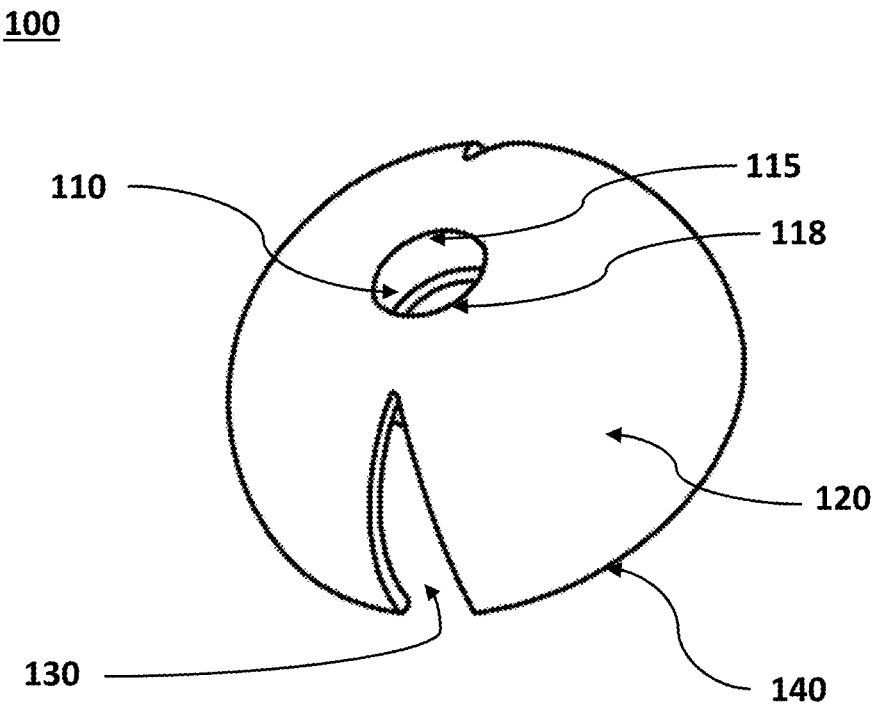
FIG. 1 shows a top front right perspective view of an ear tip in accordance with a first embodiment.

Referring to FIG. 1, a top front right perspective view of an ear tip 100 in accordance with a first embodiment is shown. The ear tip 100 includes a hollow main body 110 with a first end 115 of the main body 110 defining a first opening 118. A peripheral portion 120 is integrally coupled to the hollow main body 110 at the first opening 118 defined by the first end 115. The peripheral portion 120 is shaped to conform to a surface of an ear canal, such as but not limited to dome, conical, tapered cylinder or any other suitable shapes which can be safely inserted and removed from an ear canal. A plurality of wedge-shaped apertures 130 are formed integrally and spaced around an outer edge 140 of the peripheral portion 120. The main body 110 and peripheral portion 120 of the ear tip 100 can be made from an elastomer material that is safe to insert into a human ear canal. Alternatively, the main body 110 of the ear tip 100 can be made from a first material, and the peripheral portion 120 can be made from a second material. The selection of the material can be based on the desired flexibility and strength of the main body 110 and the peripheral portion 120. The peripheral portion 120 and the wedge-shaped apertures 130 can preferably be formed by injection molding. Structural elements such as ribs, rings, bracings or gussets can be formed on the main body 110 and the peripheral portion 120 in order to vary the flexibility and strength of the main body 110 and the peripheral portion 120. The flexibility and strength of the main body 110 affects the coupling strength of the ear tip 100 to the earpiece, whereas the flexibility and strength of the peripheral portion 120 affects the ability of the ear tip 100 to be retained in the ear canal. Advantageously, the wedge-shaped apertures 130 provides an unoccluded air path from free air into the ear canal, reducing pressure and temperature build-up inside the ear canal for greater comfort to the user for extended period of use. The wedge-shaped apertures 130 can advantageously be formed with rounded corners and/or edges to reduce discomfort to the user. Thus, it can be seen that an ear tip has been disclosed which successfully, simultaneously and advantageously prevents occlusion effect and increases the comfort of an earpiece for a user for extended period of use.

Figure 2:
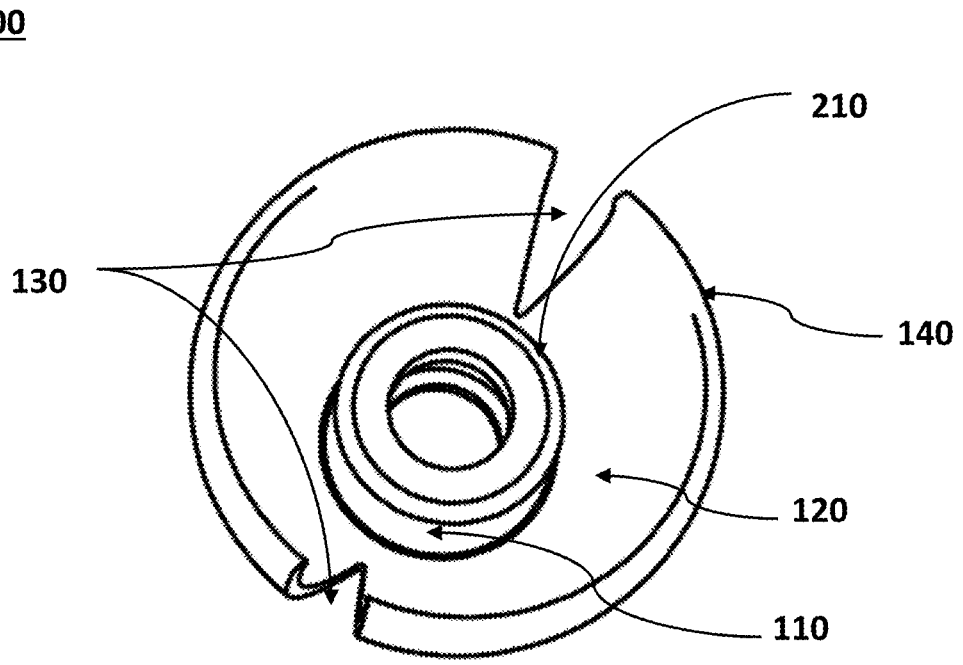
FIG. 2 shows a bottom front left perspective view of the ear tip of FIG. 1 in accordance with the first embodiment.

A bottom front left perspective view of the ear tip 100 of FIG. 1 in accordance with the first embodiment is shown in FIG. 2. The main body 110 projects outwards away from the first end to a second end 210. The peripheral portion 120 can advantageously be formed with rounded edges and/or have edges that are curved inwards towards the axis formed by the first end and the second end 210.

Figure 3:
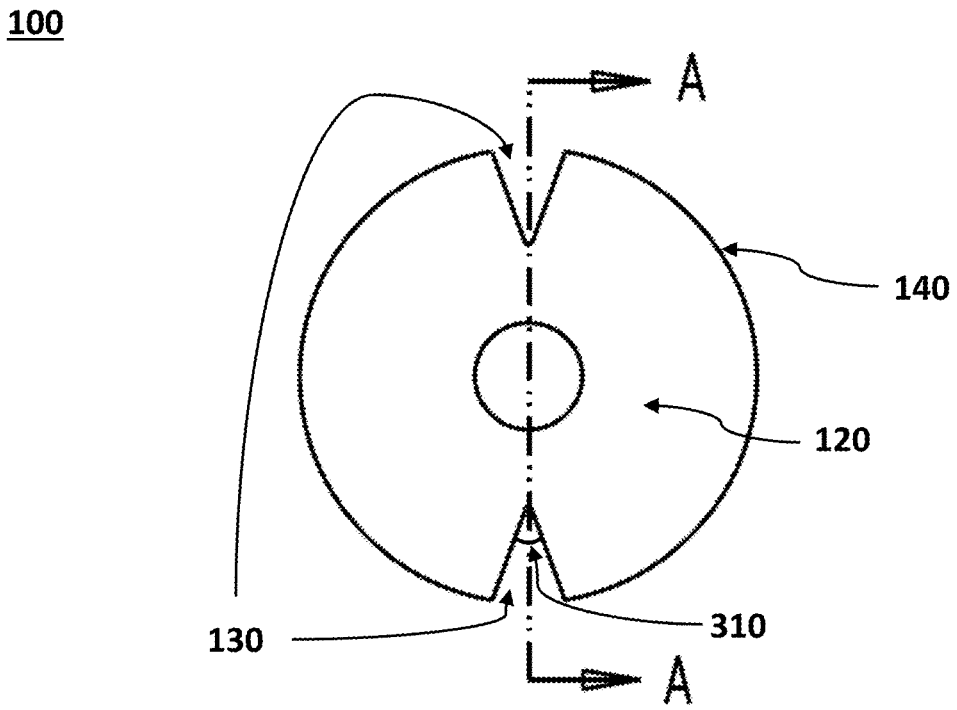
FIG. 3 shows a top planar view of the ear tip of FIG. 1 in accordance with the first embodiment.

FIG. 3 shows a top planar view of the ear tip 100 of FIG. 1 in accordance with the first embodiment. There are two substantially wedge-shape apertures 130 positioned directly opposite each other. Although it is shown that the two wedge-shaped apertures 130 are directly opposite each other, it will be clear to a skilled person that in an alternate embodiment, the wedge-shaped apertures 130 could be spaced anywhere around the outer edge 140 of the peripheral portion 120. In other embodiments, there could also be more than two substantially wedge-shape apertures 130 formed integrally and spaced around the outer edge 140 of the peripheral portion 120. Each of the plurality of wedge-shaped apertures 130 preferably has a wedge angle 310 of between 40 to 60 degrees. Although it is shown that the wedge-shaped apertures 130 has the same wedge angles 310, it will be clear to a skilled person that in an alternative embodiment, the wedge-shaped apertures 130 can have different wedge angles 310. According to various embodiments, the total sum of all the wedge angles 310 from the wedge-shaped apertures 130 cannot exceed 360 degrees. More preferably, the total sum of all the wedge angles 310 from the wedge-shaped apertures 130 cannot exceed 180 degrees.

Figure 4:
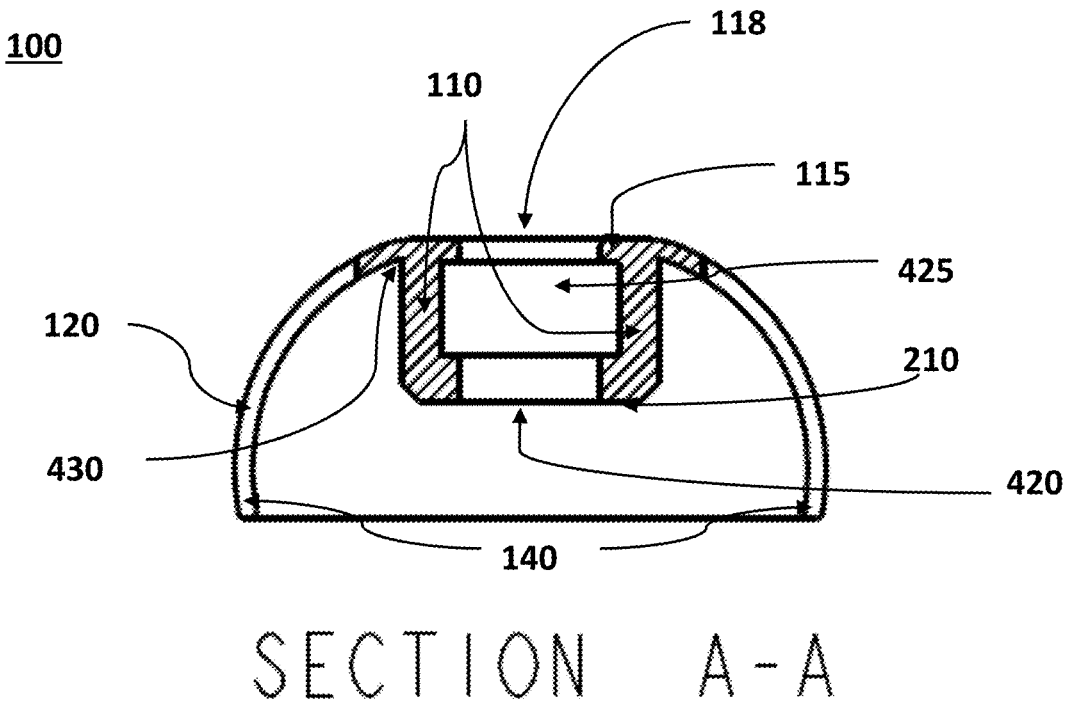
FIG. 4 shows a side cross sectional view of the ear tip taken along the dashed line A-A in FIG. 3 in accordance with the first embodiment.

A side cross sectional view of the ear tip 100 taken along the dashed line A-A in FIG. 3 in accordance with the first embodiment is shown in FIG. 4. The main body 110 includes a first opening 118 that is defined by the first end 115, and a second opening 420 that is defined by the second end 210. The first opening 118 and the second opening 420 are positioned on opposite ends of the hollow main body 110, with a hollow space 425 formed therein between. The hollow space 425 may be one contiguous section, or may be a plurality of sections of various or same volumes. The second opening 420 is suitable for coupling to a coupling portion of a housing of the earpiece (not shown). The second opening 420 and/or the coupling portion of the housing of the earpiece are adapted to be acoustically coupled with each other. The peripheral portion 120 is integrally coupled to an outer surface 430 of the hollow main body 110 at the first opening 118 of the first end 115. In the present embodiment, the height of the main body 110 is shorter than the height of the dome-shaped peripheral portion 120. However, it will be clear to a skilled person that in an alternate embodiment, the height of the main body 110 can extend beyond the height of the peripheral portion 120. In the present embodiment, the first opening 118 and the second opening 420 are of the same size and shape. However, it will be clear to a skilled person that in an alternate embodiment, the first opening 118 and the second opening 420 can be of different sizes and/or shapes.

Figure 5:
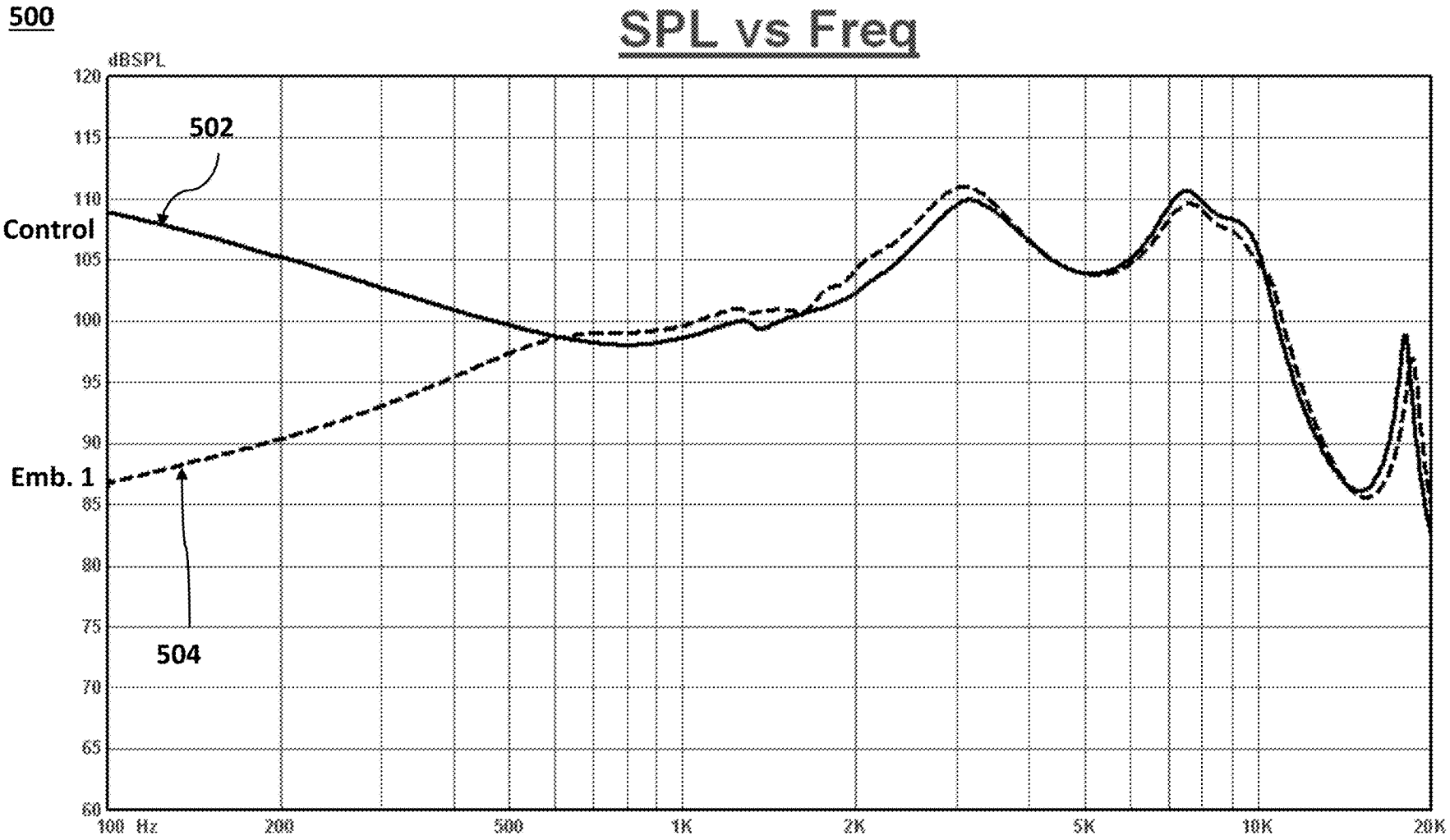
FIG. 5 shows a SPL vs Frequency characteristic graph of an exemplary earpiece with the ear tip of FIG. 1 in accordance with the first embodiment.

For example, FIG. 5 shows a SPL vs Frequency characteristic graph 500 of an exemplary earpiece with the ear tip 100 of FIG. 1 in accordance with the first embodiment. The SPL vs Frequency characteristic is measured by a microphone installed at an eardrum position of a pseudo-ear on which the exemplary earpiece acting as an acoustic source coupled with the ear tip 100 of the first embodiment is mounted. The horizontal axis represents frequency and the vertical axis represents sound pressure level (SPL), and the SPL/Frequency characteristic 502 and 504 of the exemplary earpiece acting as an acoustic source coupled with a control ear tip that has a fully intact peripheral portion without any apertures and the ear tip 100 of the first embodiment are respectively obtained. The control ear tip can also be any other ear tip that is capable of forming a complete seal in the ear canal. From FIG. 5, it can be observed that a measured SPL corresponding to a mid-range frequency advantageously increases by at least 2 dB at a region of about 1.5 kHz to about 3 kHz (e.g. 1.5 kHz to 3 kHz) when the control ear tip is changed to the ear tip 100 of the first embodiment. The region where this increase in SPL is observed may vary within a 600 Hz to 3 kHz range depending on the earpiece being used. The ear tip 100 of the first embodiment also retains a minimum of 85 dB SPL of the low frequency component. Advantageously, the ear tip 100 increases the SPL corresponding to the mid-range frequency, and at the same time retains some (e.g. a minimum of 85 dB SPL) of the low frequency components of the acoustic source. Thus, it can be seen that an ear tip has been disclosed which successfully, simultaneously and advantageously increases the mid-range perception of an earpiece for a user, yet retains a portion of the lower frequencies.

Figure 6:
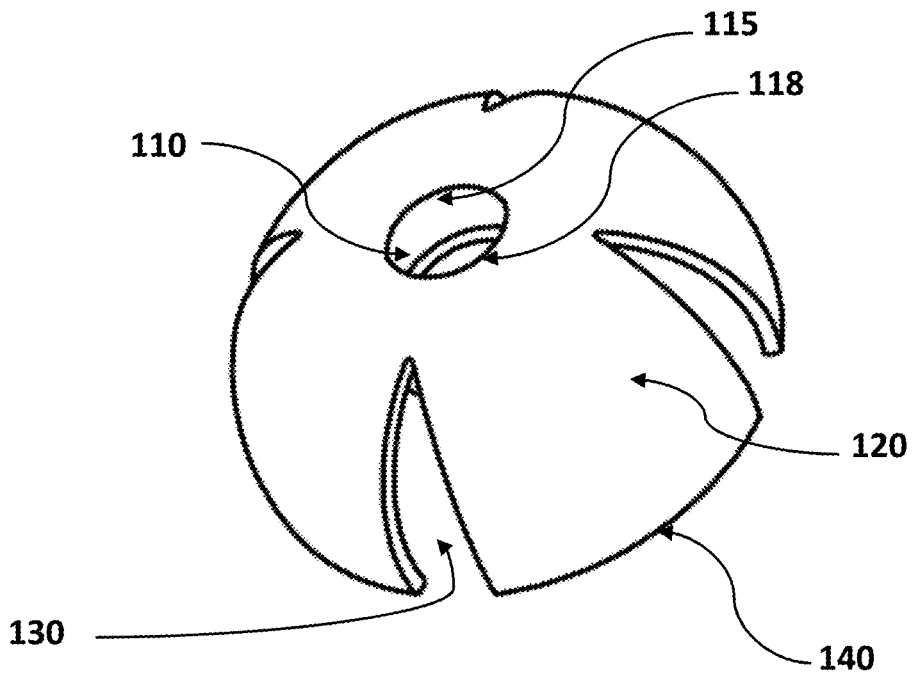
FIG. 6 shows a top front right perspective view of an ear tip in accordance with a second embodiment.

Referring to FIG. 6, a top front right perspective view of an ear tip 600 in accordance with a second embodiment is shown. The ear tip 600 includes a hollow main body 110 with a first end 115 of the main body 110 defining a first opening 118. A peripheral portion 120 is integrally coupled to the hollow main body 110 at the first opening 118 defined by the first end 115. The peripheral portion 120 is shaped to conform to a surface of an ear canal, such as but not limited to dome, conical, tapered cylinder or any other suitable shapes which can be safely inserted and removed from an ear canal. Four wedge-shaped apertures 130 are formed integrally and spaced around an outer edge 140 of the peripheral portion 120. The main body 110 and peripheral portion 120 of the ear tip 600 can be made from an elastomer material that is safe to insert into a human ear canal. Alternatively, the main body 110 of the ear tip 100 can be made from a first material, and the peripheral portion 120 can be made from a second material. The selection of the material can be based on the desired flexibility and strength of the main body 110 and the peripheral portion 120. The peripheral portion 120 and the wedge-shaped apertures 130 can preferably be formed by injection molding. Structural elements such as ribs, rings, bracings or gussets can be formed on the main body 110 and the peripheral portion 120 in order to vary the flexibility and strength of the main body 110 and the peripheral portion 120. The flexibility and strength of the main body 110 affects the coupling strength of the ear tip 600 to the earpiece, whereas the flexibility and strength of the peripheral portion 120 affects the ability of the ear tip 600 to be retained in the ear canal. Advantageously, the wedge-shaped apertures 130 provides an unoccluded air path from free air into the ear canal, reducing pressure and temperature build-up inside the ear canal for greater comfort to the user for extended period of use. The wedge-shaped apertures 130 can advantageously be formed with rounded corners and/or edges to reduce discomfort to the user. Thus, it can be seen that an ear tip has been disclosed which successfully, simultaneously and advantageously prevents occlusion effect and increases the comfort of an earpiece for a user for extended period of use.

Figure 7:
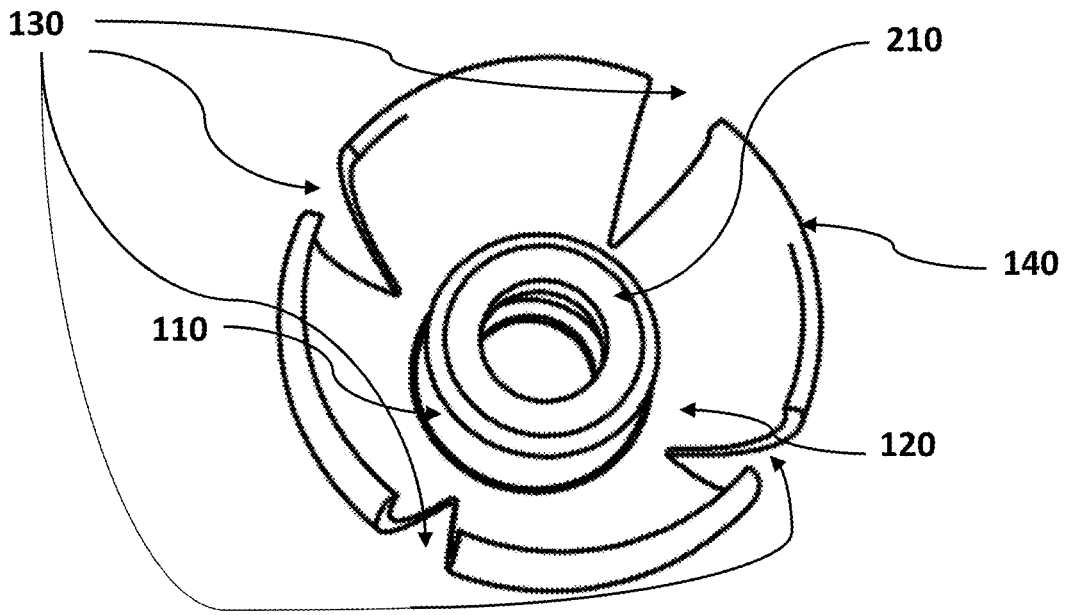
FIG. 7 shows a bottom front left perspective view of the ear tip of FIG. 6 in accordance with the second embodiment.

A bottom front left perspective view of the ear tip 600 of FIG. 6 in accordance with the second embodiment is shown in FIG. 7. The main body 110 projects outwards away from the first end to a second end 210. The peripheral portion 120 can advantageously be formed with rounded edges and/or have edges that are curved inwards towards the axis formed by the first end and the second end 210.

Figure 8:
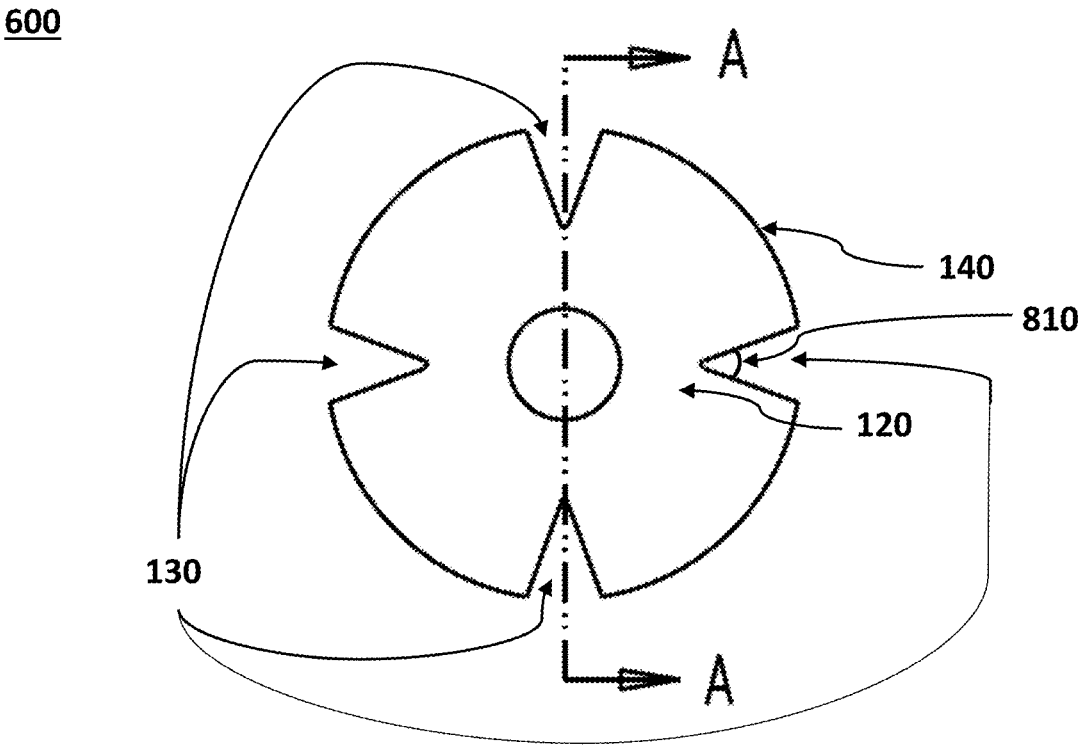
FIG. 8 shows a top planar view of the ear tip of FIG. 6 in accordance with the second embodiment.

FIG. 8 shows a top planar view of the ear tip 600 of FIG. 6 in accordance with the second embodiment. There are four substantially wedge-shape apertures 130 positioned in the 12 o'clock, 3 o'clock, 6 o'clock and 9 o'clock positions, formed integrally and spaced uniformly around the outer edge 140 of the peripheral portion 120. Although it is shown that the four wedge-shaped apertures 130 are spaced uniformly around the outer edge 140 of the peripheral portion 120, it will be clear to a skilled person that in an alternate embodiment, the wedge-shaped apertures 130 could be spaced anywhere around the outer edge 140 of the peripheral portion 120. Each of the plurality of wedge-shaped apertures 130 preferably has a wedge angle 810 of between 40 to 60 degrees. Although it is shown that the wedge-shaped apertures 130 has the same wedge angles 810, it will be clear to a skilled person that in an alternative embodiment, the wedge-shaped apertures 130 can have different wedge angles 810. According to various embodiments, the total sum of all the wedge angles 810 from the wedge-shaped apertures 130 cannot exceed 360 degrees. More preferably, the total sum of all the wedge angles 810 from the wedge-shaped apertures 130 cannot exceed 180 degrees.

Figure 9:
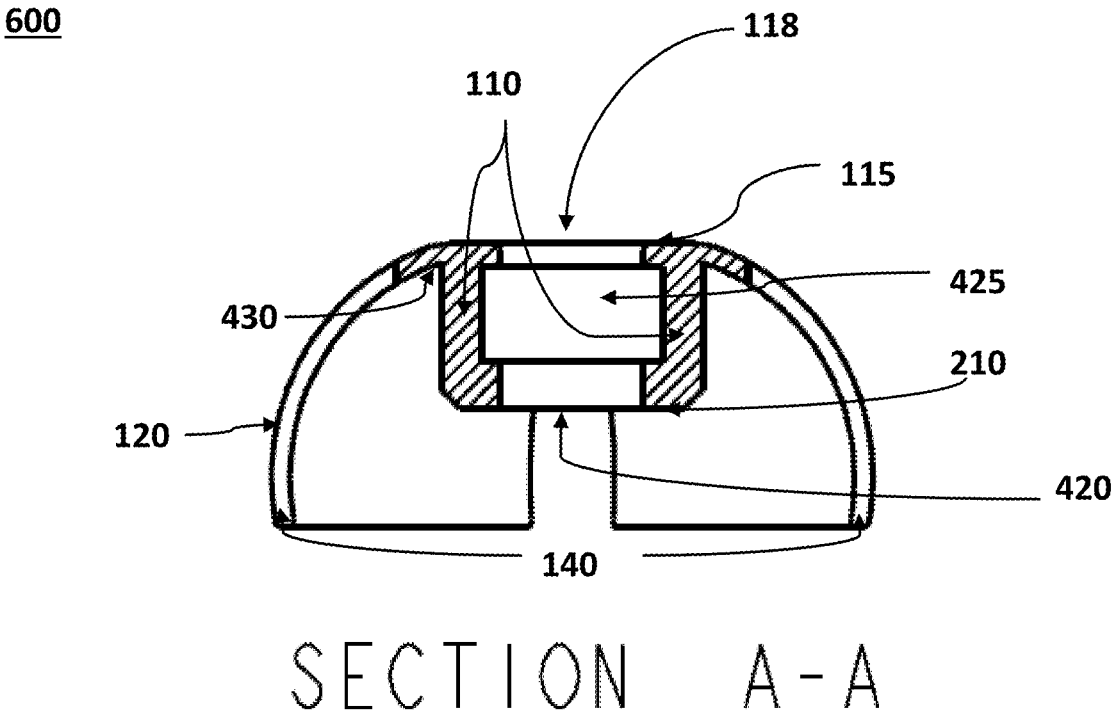
FIG. 9 shows a side cross sectional view of the ear tip taken along the dashed line A-A in FIG. 8 in accordance with the second embodiment.

A side cross sectional view of the ear tip 600 taken along the dashed line A-A in FIG. 8 in accordance with the second embodiment is shown in FIG. 9. The main body 110 includes a first opening 118 that is defined by the first end 115, and a second opening 420 that is defined by the second end 210. The first opening 118 and the second opening 420 are positioned on opposite ends of the hollow main body 110, with a hollow space 425 formed therein between. The hollow space 425 may be one contiguous section, or may be a plurality of sections of various or same volumes. The second opening 420 is suitable for coupling to a coupling portion of a housing of the earpiece (not shown). The second opening 420 and/or the coupling portion of the housing of the earpiece are adapted to be acoustically coupled with each other. The peripheral portion 120 is integrally coupled to an outer surface 430 of the hollow main body 110 at the first opening 118 of the first end 115. In the present embodiment, the height of the main body 110 is shorter than the height of the dome-shaped peripheral portion 120. However, it will be clear to a skilled person that in an alternate embodiment, the height of the main body 110 can extend beyond the height of the peripheral portion 120. In the present embodiment, the first opening 118 and the second opening 420 are of the same size and shape. However, it will be clear to a skilled person that in an alternate embodiment, the first opening 118 and the second opening 420 can be of different sizes and/or shapes.

Figure 10:
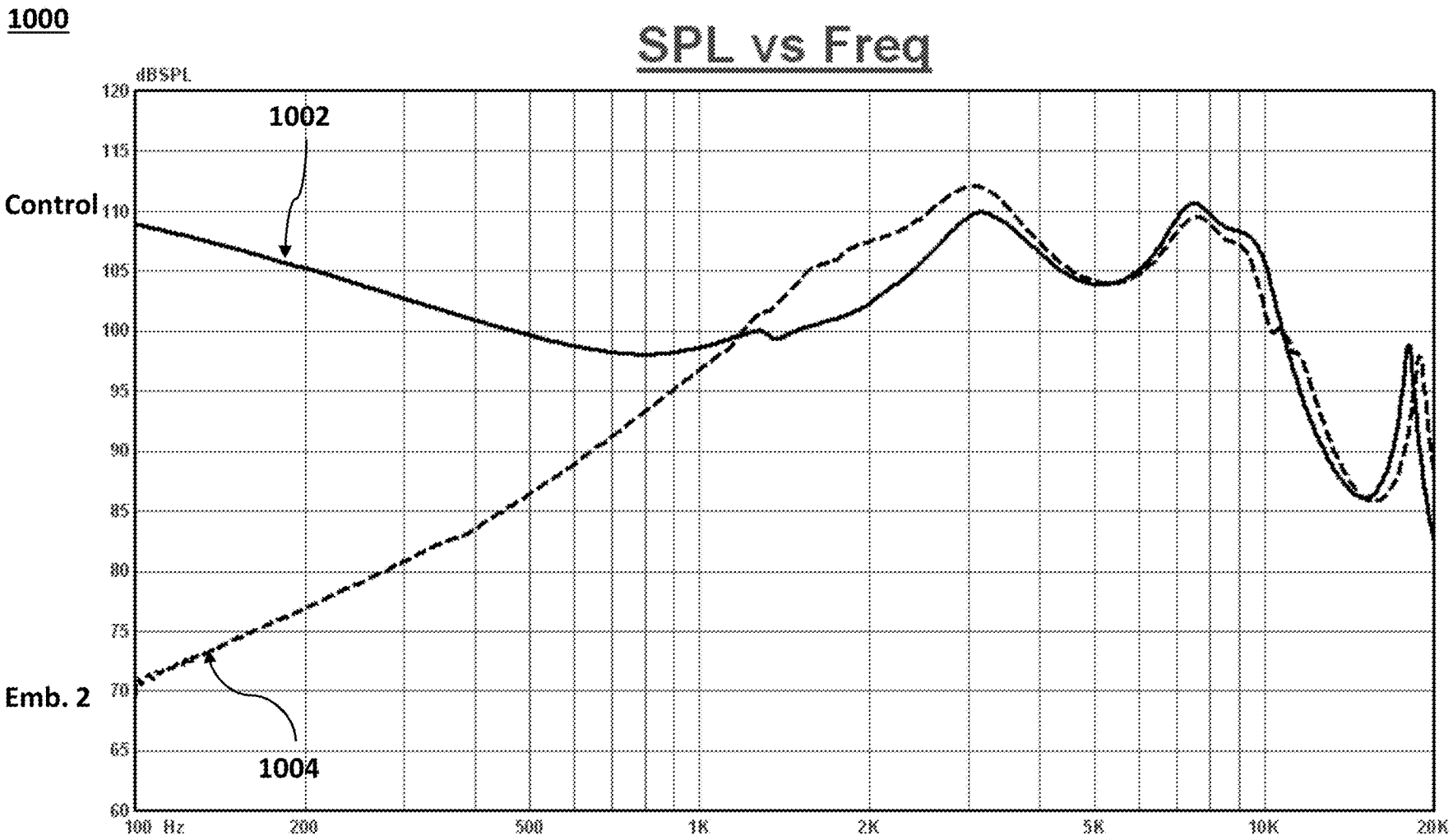
FIG. 10 shows a SPL vs Frequency characteristic graph of an exemplary earpiece with the ear tip of FIG. 6 in accordance with the second embodiment.

For example, FIG. 10 shows a SPL vs Frequency characteristic graph 1000 of an exemplary earpiece with the ear tip 600 of FIG. 6 in accordance with the second embodiment. The SPL vs Frequency characteristic is measured by a microphone installed at an eardrum position of a pseudo-ear on which the exemplary earpiece acting as an acoustic source coupled with the ear tip 600 of the second embodiment is mounted. The horizontal axis represents frequency and the vertical axis represents sound pressure level (SPL), and the SPL/Frequency characteristic 1002 and 1004 of the exemplary earpiece acting as an acoustic source coupled with a control ear tip that has a fully intact peripheral portion without any apertures and the ear tip 600 of the second embodiment are respectively obtained. The control ear tip can also be any other ear tip that is capable of forming a complete seal in the ear canal. From FIG. 10, it can be observed that a measured SPL corresponding to a mid-range frequency advantageously increases by at least 5 dB at a region of about 1.5 kHz to about 3 kHz (e.g. 1.5 kHz to 3 kHz) when the control ear tip is changed to the ear tip 600 of the second embodiment. The region where this increase in SPL is observed may vary within a 600 Hz to 3 kHz range depending on the earpiece being used. The ear tip 600 of the second embodiment also retained a minimum of 70 dB SPL of the low frequency component. Advantageously, the ear tip 600 increases the SPL corresponding to the mid-range frequency, and at the same time retains some (e.g. a minimum of 70 dB SPL) of the low frequency components of the acoustic source. Thus, it can be seen that an ear tip has been disclosed which successfully, simultaneously and advantageously increases the mid-range perception of an earpiece for a user, yet retains a portion of the lower frequencies.

Figure 11:
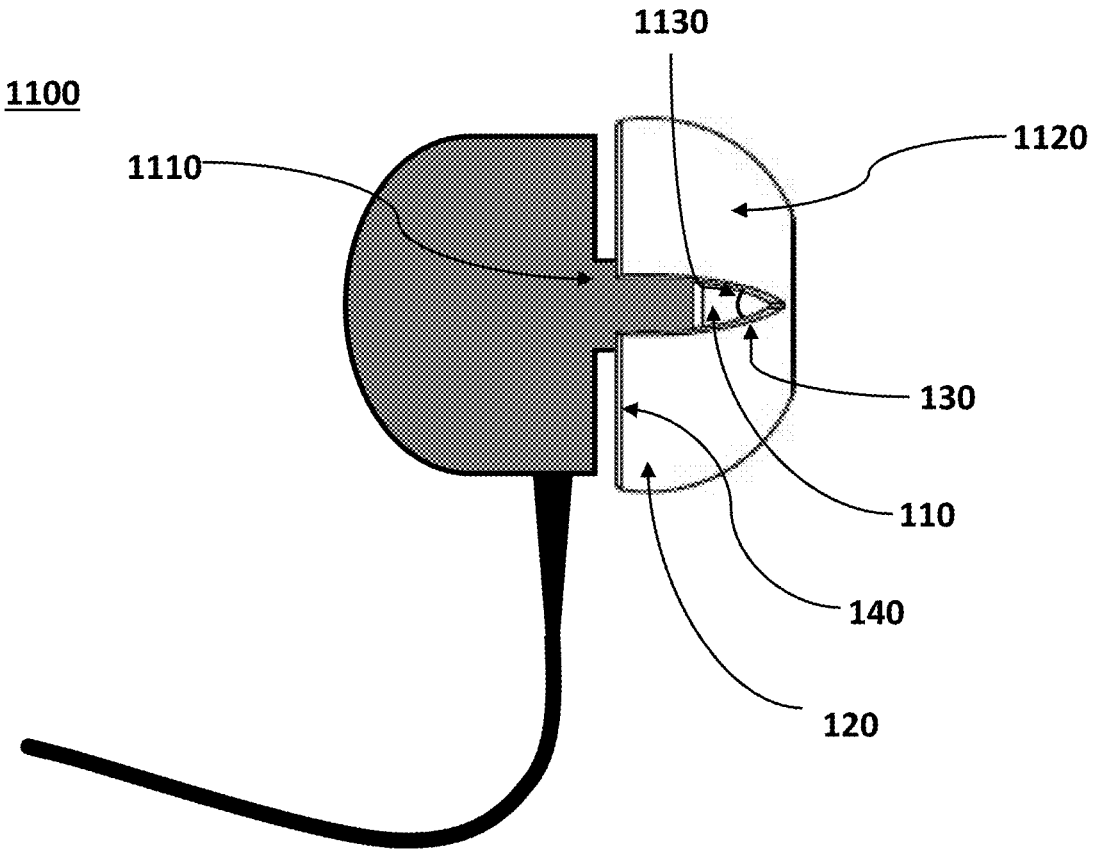
FIG. 11 shows a side planar view of an earpiece in accordance with an embodiment.

Referring to FIG. 11, a side planar view of an earpiece 1100 in accordance with an embodiment is shown. The earpiece 1100 includes a housing 1110 defining an acoustic passage to deliver sound energy as an acoustic source and an ear tip 1120 detachably coupled to the housing 1110. The ear tip 1120 and the acoustic passage defined by the housing 1110 are adapted to be acoustically coupled with each other. The ear tip 1120 includes a hollow main body 110 with a first end of the main body 110 defining a first opening and a second end of the main body 110 defining a second opening for detachably coupling to the acoustic passage. A peripheral portion 120 is integrally coupled to an outer surface of the hollow main body 110 at the first opening and shaped to conform to a surface of an ear canal. The peripheral portion is shaped to conform to a surface of an ear canal, such as but not limited to dome, conical, tapered cylinder or any other suitable shapes which can be safely inserted and removed from an ear canal. A plurality of wedge-shaped apertures 130 are formed integrally and spaced around an outer edge 140 of the peripheral portion 120. Each of the plurality of wedge-shaped apertures 130 have a wedge angle 1130 of between 40 to 60 degrees, with each of the plurality of wedge-shaped apertures 130 having same or different wedge angles 1130. According to various embodiments, the total sum of all the wedge angles 1130 from the wedge-shaped apertures 130 cannot exceed 360 degrees. More preferably, the total sum of all the wedge angles 1130 from the wedge-shaped apertures 130 cannot exceed 180 degrees. The main body 110 and peripheral portion 120 of the ear tip 1120 can be made from an elastomer material that is safe to insert into a human ear. Alternatively, the main body of the ear tip 1120 can be made from a first material, and the peripheral portion 120 can be made from a second material. The selection of the material can be based on the desired flexibility and strength of the main body 110 and the peripheral portion 120. Although the first opening and the second opening are typically of the same size and shape, it will be clear to a skilled person that in an alternative embodiment, the first opening and the second opening can be of different sizes and/or shapes. The peripheral portion 120 and the wedge-shaped apertures 130 can preferably be formed by injection molding. Structural elements such as ribs, rings, bracings or gussets can be formed on the main body 110 and the peripheral portion 120 in order to vary the flexibility and strength of the main body 110 and the peripheral portion 120. The flexibility and strength of the main body 110 affects the coupling strength of the ear tip 1120 to the housing 1110 of the earpiece 1100, whereas the flexibility and strength of the peripheral portion 120 affects the ability of the ear tip 1120 to be retained in the ear canal. Advantageously, the wedge-shaped apertures 130 provides an un-occluded air path from free air into the ear canal, reducing pressure and temperature build-up inside the ear canal for greater comfort to the user for extended period of use. The wedge-shaped apertures 130 can advantageously be formed with rounded corners and/or edges to reduce discomfort to the user. The peripheral portion 120 can be formed with rounded edges and/or have edges that are curved inwards towards the acoustic passage defined by the housing 1110 to reduce discomfort to the user. The SPL vs Frequency characteristic of the earpiece 1100 is measured by a microphone installed at an eardrum position of a pseudo-ear on which the earpiece 1100 having ear tip 1120 is mounted. The horizontal axis represents frequency and the vertical axis represents sound pressure level (SPL), and the SPL/Frequency characteristic of the exemplary earpiece 1100 acting as an acoustic source having coupled to the housing 1110 a control ear tip that has a fully intact peripheral portion without any apertures and the ear tip 1120 corresponding to the ear tip 100 of the first embodiment are respectively obtained. The control ear tip can also be any other ear tip that is capable of forming a complete seal in the ear canal. From FIG. 5, it can be observed that a measured SPL corresponding to a mid-range frequency advantageously increases by at least 2 dB at a region of about 1.5 kHz to about 3 kHz (e.g. 1.5 kHz to 3 kHz) when the control ear tip coupled to the housing 1110 is changed to the ear tip 100 of the first embodiment. The region where this increase in SPL is observed may vary within a 600 Hz to 3 kHz range depending on the design of the earpiece being used. Design elements which may cause the variance includes but is not limited to the choice of the electronic components, acoustic components, and/or mechanical structure used in the ear piece 1100. The ear tip 1120 corresponding to the ear tip 100 of the first embodiment also retains a minimum of 85 dB SPL of the low frequency component. Advantageously, the ear tip 1120 corresponding to the ear tip 100 of the first embodiment increases the SPL corresponding to the mid-range frequency, and at the same time retains some (e.g. a minimum of 85 dB SPL) of the low frequency components of the ear piece 1100. Thus, it can be seen that an earpiece 1100 has been disclosed which successfully, simultaneously and advantageously increases the mid-range perception of an earpiece for a user, yet retains a portion of the lower frequencies.

In an alternative embodiment, the ear tip 1120 coupled to the housing 1110 in earpiece 1100 corresponds to the ear tip 600 of the second embodiment that has exactly four wedge-shaped apertures. From FIG. 10, it can be observed that the measured SPL corresponding to the mid-range frequency advantageously increases by at least 5 dB at a region of about 1.5 kHz to about 3 kHz (e.g. 1.5 kHz to 3 kHz) when the control ear tip coupled to the housing 1110 is changed to the ear tip 600 of the second embodiment. The region where this increase in SPL is observed may vary within a 600 Hz to 3 kHz range depending on the design of the earpiece being used. Design elements which may cause the variance includes but is not limited to the choice of the electronic components, acoustic components, and/or mechanical structure used in the ear piece 1100. The ear tip 1120 corresponding to the ear tip 600 of the second embodiment also retains a minimum of 70 dB SPL of the low frequency component. Advantageously, the ear tip 1120 corresponding to the ear tip 600 of the second embodiment increases the SPL corresponding to the mid-range frequency, and at the same time retains some (e.g. a minimum of 70 dB SPL) of the low frequency components of the ear piece 1100. Thus, it can be seen that an earpiece 1100 has been disclosed which successfully, simultaneously and advantageously increases the mid-range perception of an earpiece for a user, yet retains a portion of the lower frequencies.

Thus, it can be seen that an ear tip having wedge-shaped apertures and an earpiece having the ear tip has been provided. An advantage of the present invention is that the wedge-shaped apertures provides an un-occluded air path from free air into the ear canal, overcoming occlusion effect of in-ear earpieces, reducing pressure and temperature build-up inside the ear canal for greater comfort to the user for extended usage, increasing the SPL corresponding to a portion of the mid-range frequency and yet retaining some of the low frequency audio presented to the user.

While exemplary embodiments have been presented in the foregoing detailed description of the present embodiments, it should be appreciated that a vast number of variations exists. It should further be appreciated that the exemplary embodiments are only examples, and are not intended to limit the scope, applicability, operation, or configuration of the invention in any way. Rather, the foregoing detailed description will provide those skilled in the art with a convenient road map for implementing exemplary embodiments of the invention, it being understood that various changes may be made in the function and arrangement of steps and method of operation described in the exemplary embodiments without departing from the scope of the invention as set forth in the appended claims.

What is claimed is:

1. An ear tip for increasing mid-range frequency perception of an earpiece, comprising:

a hollow main body comprising:

a first end of the main body defining a first opening; and a second end of the main body defining a second opening for coupling to a coupling portion of a housing of the earpiece; and a peripheral portion integrally coupled to an outer surface of the first opening and shaped to conform to a surface of an ear canal, wherein the peripheral portion has an outer edge with a plurality of wedge-shaped apertures formed integrally and spaced around the outer edge, and wherein the second opening and/or the coupling portion of the housing are adapted to be acoustically coupled with each other.

2. The ear tip of claim 1, wherein when coupled to the earpiece has a measured SPL corresponding to a mid-range frequency, and the measured SPL corresponding to the mid-range frequency increases by at least 2 dB as compared to the earpiece coupled with a control ear tip from about 1.5 kHz to about 3 kHz, wherein the control ear tip has a fully intact peripheral portion without any apertures and/or wherein optionally the control ear tip is capable of forming a complete seal in the ear canal.

3. The ear tip of claim 1, wherein each of the plurality of wedge-shaped apertures has a wedge angle of between 40 to 60 degrees.

4. The ear tip of claim 1, wherein the main body and the peripheral portion are made from an elastomer material.

5. The ear tip of claim 1, wherein the main body and the peripheral portion are made from a first material and a second material respectively.

6. The ear tip of claim 1, wherein the first opening and the second opening are of different sizes and/or shapes.

7. The ear tip of claim 1, wherein the wedge-shaped apertures are formed with rounded corners and/or edges.

8. The ear tip of claim 1, wherein the peripheral portion and the wedge-shaped apertures are formed by injection molding.

9. The ear tip of claim 1, wherein the plurality of wedge-shaped apertures comprises of at least four wedge-shaped apertures.

10. The ear tip of claim 9, wherein the earpiece has a measured SPL corresponding to a mid-range frequency, and the measured SPL corresponding to the mid-range frequency increases by at least 5 dB as compared to the earpiece coupled with a control ear tip from about 1.5 kHz to about 3 kHz, wherein the control ear tip has a fully intact peripheral portion without any apertures and/or wherein optionally the control ear tip is capable of forming a complete seal in the ear canal.

11. An earpiece comprising:

a housing defining an acoustic passage to deliver sound energy as an acoustic source; and an ear tip detachably coupled to the housing, comprising:

a hollow main body comprising:

a first end of the main body defining a first opening; and a second end of the main body defining a second opening for detachably coupling to the acoustic passage; and a peripheral portion integrally coupled to an outer surface of the first opening and shaped to conform to a surface of an ear canal, wherein the peripheral portion has an outer edge with a plurality of wedge-shaped apertures formed integrally and spaced around the outer edge, and wherein the second opening and/or the acoustic passage are adapted to be acoustically coupled with each other.

12. The earpiece of claim 11, wherein the earpiece has a measured SPL corresponding to a mid-range frequency, and the measured SPL corresponding to the mid-range frequency increases by at least 2 dB as compared to the earpiece coupled with a control ear tip from about 1.5 kHz to about 3 kHz wherein the control ear tip has a fully intact peripheral portion and/or wherein optionally the control ear tip is capable of forming a complete seal in the ear canal.

13. The earpiece of claim 11, wherein each of the plurality of wedge-shaped apertures has a wedge angle of between 40 to 60 degrees.

14. The earpiece of claim 11, wherein the main body and the peripheral portion are made from an elastomer material.

15. The earpiece of claim 11, wherein the main body and the peripheral portion are made from a first material and a second material respectively.

16. The earpiece of claim 11, wherein the first opening and the second opening are of different sizes and/or shapes.

17. The earpiece of claim 11, wherein the wedge-shaped apertures are formed with rounded corners and/or edges.

18. The earpiece of claim 11, wherein the peripheral portion and the wedge-shaped apertures are formed by injection molding.

19. The earpiece of claim 11, wherein the plurality of wedge-shaped apertures comprises of only four wedge-shaped apertures.

20. The earpiece of claim 19, wherein the earpiece has a measured SPL corresponding to a mid-range frequency, and the measured SPL corresponding to the mid-range frequency increases by at least 5 dB as compared to the earpiece coupled with a control ear tip from about 1.5 kHz to about 3 kHz, wherein the control ear tip has a fully intact peripheral portion and/or wherein optionally the control ear tip is capable of forming a complete seal in the ear canal.

* * * * *